US008961234B2

(12) United States Patent
Shani et al.

(10) Patent No.: US 8,961,234 B2
(45) Date of Patent: Feb. 24, 2015

(54) PCB CONNECTION UNIT

(75) Inventors: Haim Shani, Shoam (IL); Shlomi Marshanski, Ra'anana (IL); Gabriel Dekel, Shoam (IL)

(73) Assignee: Unitronics (1989) (R"G) Ltd., Airport City, IL (US)

( * ) Notice: Subject to any disclaimer, the term of this patent is extended or adjusted under 35 U.S.C. 154(b) by 18 days.

(21) Appl. No.: 13/572,653

(22) Filed: Aug. 12, 2012

(65) Prior Publication Data

US 2013/0040497 A1 Feb. 14, 2013

Related U.S. Application Data

(60) Provisional application No. 61/522,405, filed on Aug. 11, 2011.

(51) Int. Cl.
*H01R 12/72* (2011.01)
*H01R 12/73* (2011.01)

(52) U.S. Cl.
CPC ..... *H01R 12/721* (2013.01); *H01R 12/73* (2013.01)
USPC ..... 439/629

(58) Field of Classification Search
USPC ..... 439/629, 65, 701, 74, 79, 660, 327, 439/328, 627
See application file for complete search history.

(56) References Cited

U.S. PATENT DOCUMENTS

| | | | | | |
|---|---|---|---|---|---|
| 5,110,298 | A * | 5/1992 | Dorinski et al. | 439/65 |
| 5,494,451 | A * | 2/1996 | Bowers | 439/328 |
| 5,844,783 | A * | 12/1998 | Kojima | 361/777 |
| 6,068,518 | A * | 5/2000 | McEuen | 439/660 |
| 6,332,267 | B1 * | 12/2001 | Davis et al. | 29/830 |
| 6,769,927 | B2 * | 8/2004 | Brewer | 439/328 |
| 6,986,667 | B2 * | 1/2006 | Chang et al. | 439/65 |
| 7,203,074 | B1 * | 4/2007 | Yaung et al. | 361/784 |
| 7,448,873 | B2 * | 11/2008 | Weber | 439/31 |
| 7,611,358 | B2 * | 11/2009 | Cox et al. | 439/65 |
| 7,618,283 | B1 * | 11/2009 | Costello | 439/511 |
| 7,959,445 | B1 * | 6/2011 | Daily et al. | 439/65 |
| 2004/0092168 | A1 * | 5/2004 | Vadasz et al. | 439/631 |
| 2007/0275587 | A1 * | 11/2007 | Chang et al. | 439/327 |

* cited by examiner

*Primary Examiner* — Alexander Gilman
(74) *Attorney, Agent, or Firm* — Eitan, Mehulal & Sadot

(57) ABSTRACT

An electronic device comprising a base printed circuit board (PCB); a first edge card socket mounted on said base PCB, said socket having PCB contacts; and a PCB connection unit having PCB contacts thereon, said unit being slideably connectable to said first edge card socket and adapted to be slideably inserted into, and to make electrical contact with, a second edge card socket mounted on a second base PCB.

12 Claims, 5 Drawing Sheets

PCB CONNECTION UNIT

CROSS-REFERENCE TO RELATED APPLICATIONS

This application claims benefit from U.S. Provisional Patent Application No. 61/522,405, filed 11 Aug. 2011, which is hereby incorporated in its entirety by reference.

FIELD OF THE INVENTION

The present invention relates to connectors for electronic devices.

BACKGROUND OF THE INVENTION

Electronic devices are frequently designed to have a modular configuration. The electronic circuits may be arranged into modular units (modules) each module including circuitry dedicated to a particular function or number of functions. In some electronic devices, each module may include one or more printed circuit boards (PCBs) enclosed within a housing. An example of such an electronic device may be a programmable logic controller (PLC).

The PLC is generally an electronic processing system designed to control compounded (multi-task) processes. Some of these processes may include applications which involve automation, for example, in automatic or semi-automatic manufacturing facilities or other types of machine-based processing facilities. In these applications, the PLC may be used to automatically control specific tasks performed by machinery.

The PLC is typically modular in design to allow adding or removing of modules according to the application. Some modules may be, for example, for processing data, others may be for data input/output, others for communications, and still others may be for power conversion and/or supply. The modules may be rack mounted and are frequently physically connected in series to allow for their easy attachment and removal. Electrical connections between the modules generally include use of cables and connectors, although alternate means of connections may be used. An example of an alternate means of connection is described in U.S. Pat. No. 7,455,528 B2 to Cox et al.

SUMMARY OF THE PRESENT INVENTION

There is provided, in accordance with an embodiment of the present invention, an electronic device comprising a base printed circuit board (PCB); a first edge card socket mounted on the base PCB, the socket having PCB contacts; and a PCB connection unit having PCB contacts thereon, the unit being slideably connectable to the first edge card socket and adapted to be slideably inserted into, and to make electrical contact with, a second edge card socket mounted on a second base PCB.

In accordance with an embodiment of the present invention, the PCB connection unit includes a PCB interconnect board.

In accordance with an embodiment of the present invention, the interconnect board includes conductor traces.

In accordance with an embodiment of the present invention, the interconnect board includes electrical contacts.

In accordance with an embodiment of the present invention, the PCB connection unit includes a handle.

In accordance with an embodiment of the present invention, the first edge card socket includes an opening for slideably connecting the PCB connection unit In accordance with an embodiment of the present invention, the second edge card socket includes an opening for slideably inserting the PCB connection unit.

In accordance with an embodiment of the present invention, the PCB connection unit includes a housing.

In accordance with an embodiment of the present invention, the first base PCB is in a first module and the second base PCB is in a second module.

In accordance with an embodiment of the present invention, the first module includes a window for accessing the connector.

In accordance with an embodiment of the present invention, the first module and the second module include slots.

In accordance with an embodiment of the present invention, the first module and the second module are components in a programmable logic controller (PLC).

In accordance with an embodiment of the present invention, the second base PCB is a component in a second electronic device.

BRIEF DESCRIPTION OF THE DRAWINGS

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings in which:

Figure 1:
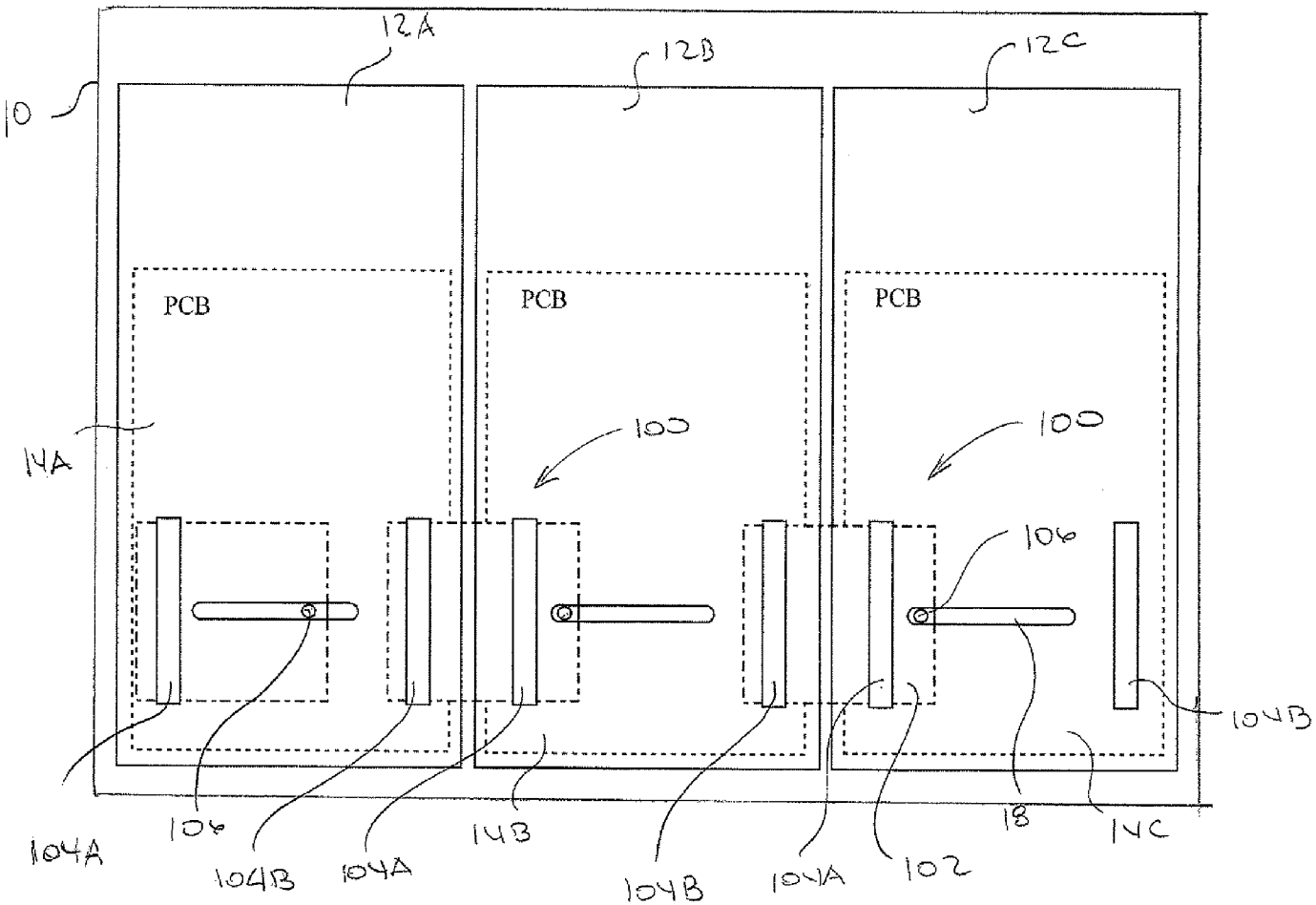
FIG. 1 schematically illustrates a view of an electronic device including modules electrically interconnected using a PCB connection unit, according to an exemplary embodiment of the present invention.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DETAILED DESCRIPTION

In the following detailed description, numerous specific details are set forth in order to provide a thorough understanding of the invention. However, it will be understood by those skilled in the art that the present invention may be practiced without these specific details. In other instances, well-known methods, procedures, and components have not been described in detail so as not to obscure the present invention.

Applicants have realized the standard data connector used to connect modules in electronic devices is slow and keeps the rate of data transfer between units relatively slow. Applicants have further realized that a faster connection may be that of a PCB connection.

Figure 2:
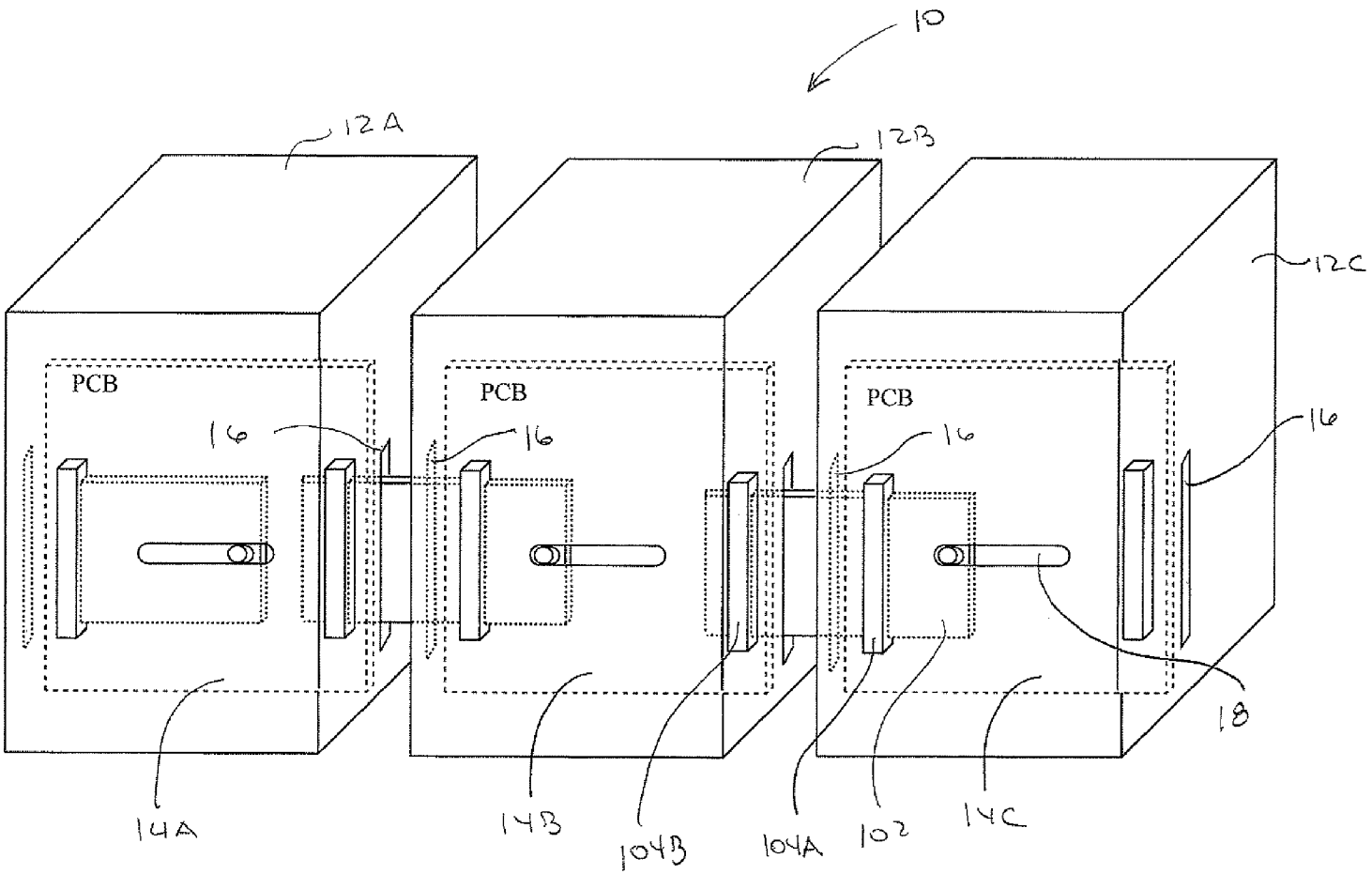
FIG. 2 schematically illustrates a perspective view of the device of FIG. 1 including the PCB connection unit, according to an exemplary embodiment of the present invention.

The main advantages of using a PCB for the actual connection are (a) higher communication speeds may be achieved due to controlled impedances in the PCB (which is an electrical property influenced by the dimensions, thickness and height, and the dielectric constant of the PCB material); and (b) reduced electromagnetic interference (EMI) in PCBs as opposed to connectors Reference is now made to FIG. 1 which schematically illustrates an electronic device 10, for example a programmable logic controller (PLC), including multiple PCB connection units 100 connecting a plurality of modules 12A-12C together, and to FIG. 2 which schematically illustrates a perspective view of PLC 10, according to an exemplary embodiment of the present invention. Modules 12A, 12B and 12C may include a base PCB 14A, 14B, and 14C with electronic circuitry for performing functions associated with the respective module (e.g. processing circuitry, I/O circuitry, power supply/conversion circuitry, etc.). Each PCB 14A, 14B and 14C may additionally include two PCB edge card sockets, a first edge card socket 104A and a second edge card socket 104B on opposing edges of the PCBs, in electrical contact with the electronic circuitry in the PCB.

According to an exemplary embodiment of the invention, PCB connection unit 100 is configured to electrically interconnect two PCBs. The PCBs may be two adjacent PCBs inside an electronic device, or may be two PCBs in adjacent modules in an electronic device/system. PCB connection unit 100 may allow serial connection of a plurality of PCBs inside an electronic device, a plurality of modules, and a plurality of electronic devices, by using the connection unit to connect one PCB to another in a chain-type configuration. For example, four PCBs may be serially connected within an electronic device by connecting one PCB to the other using PCB connection unit 100. As another example, four modules may be serially connected together by connecting at least one PCB in each module to a PCB in the adjacent module using PCB connection unit 100. The center modules, for example, may have two PCBs, one on each side, connecting to an adjacent module on each side of the module using PCB connection unit 100. Similarly, in another example, four electronic devices may be serially connected together by connecting at least one PCB in each device to a PCB in the adjacent device using PCB connection unit 100. The center device, for example, may have two PCBs, one on each side, connecting to an adjacent device on each side of the module using PCB connection unit 100. One skilled in the art may realize that a plurality of PCB connection units 100 may be used to connect a PCB to a plurality of PCBs. As an example, the plurality of PCB connection units 100 may be used to connect 4 PCBs to a PCB along all the sides of the PCB (along both sides of the length and both sides of the width of the PCB). The skilled in the art may also realize that many other connection combinations may be possible, and that the plurality of connections to one PCB may be equally applicable to all PCBs in a serial connection as well as for connection modules and devices.

According to an exemplary embodiment of the present invention, PCB connection unit 100 may electrically interconnect adjacent modules, for example, PCB 14A in module 12A with PCB 14B in module 12B, and PCB 14B in module 12B with PCB 14C in module 12C. PCB connection unit 100 may include a connector 102 which may be configured to fit into a PCB edge card socket in one PCB and into a second PCB edge card socket in an adjacent PCB, and to create an electrical path between the sockets. For example, connector 102 may fit into PCB edge card socket 104A in module 12C and into edge card socket 104B in module 14B creating the electrical path between the edge card sockets and electrically interconnecting PCBs 14B and 14C. Modules 12A-12C may include slots 16 (FIG. 2) on externally opposing walls of each module through which connector 102 may physically extend from one PCB in one module to another PCB in the adjacent module. For example, from PCB 14C through slots 16 in modules 12C and 12B, to PBC 14B, and from PCB 14B in module 12B through slots 16 in modules 12B and 12A to PCB 14A.

According to an exemplary embodiment of the present invention, PCB connection unit 100 may allow a user to electrically connect and disconnect modules, for example modules 12A and 12B, and 12B and 12C, with relative ease and in a relatively short time. PCB edge card socket 104A in each module 12A, 12B, and 12C may be configured to allow connector 102 to reciprocally slide through the socket into and out of PCB edge card socket 104B for making and breaking the electrical connection between the modules. A window 18 may be included in each module 12A-12C which may be accessed by a user to allow the user to manipulate connector 102 for electrically connecting and disconnecting adjacent PCBs (and thereby adjacent modules). For example, the user may access window 18 to disconnect one module from another when replacing a module, or to connect a newly installed module. Through window 18, the user may laterally push connector PCB 102 so that it slides through edge card socket 104A in one module and through slots 16 in the modules into edge card socket 104B in the other module, establishing the electrical connection. For disconnecting, the user may laterally pull on connector 102 through window 18, sliding the connector away from edge card socket 104B in the other module. Additionally, the user may pull on connector 102 until it is completely withdrawn from the other module. In FIGS. 1 and 2, connector 102 in module 12C is shown inserted into PCB edge card socket 104B in module 12B connecting the modules together, connector 102 in module 12B is shown inserted into PCB edge card socket 104B in module 12A connecting the modules together, and connector 102 in module 12A is shown inside the module, in a disconnect mode.

Connector 102 may include a handle or lever 16 which the user may use to reciprocally slide (laterally push and pull) the connector through PCB edge card socket 104A, into and out of PCB edge card socket 104B. Additionally or alternatively, connector 102 may include a notch or similar feature which may accommodate a tool such as, for example, a screwdriver, which may be used to by the user to laterally push and pull on the connector.

Figure 3A:
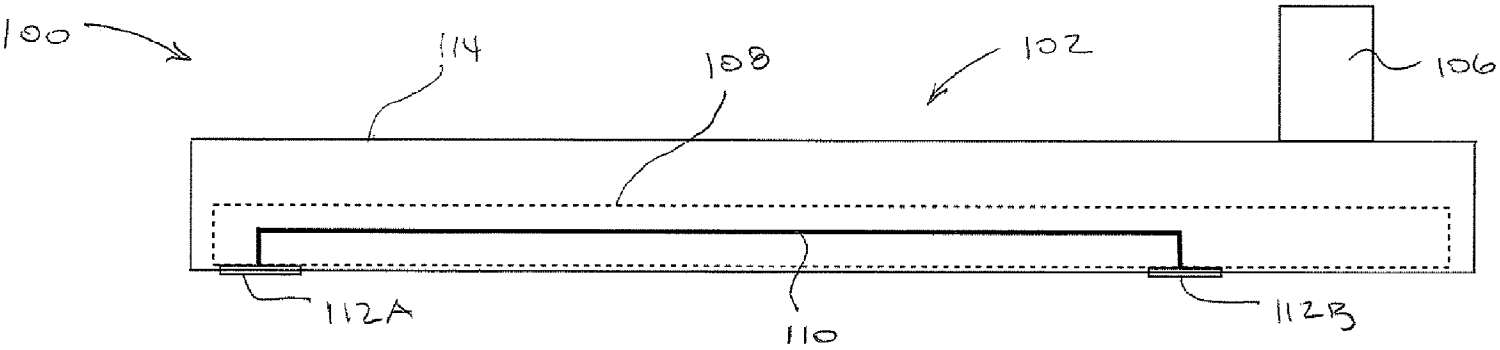
FIGS. 3A and 3B schematically illustrate a side view and a front view of the PCB connection unit, respectively, according to an exemplary embodiment of the present invention.
Figure 3B:
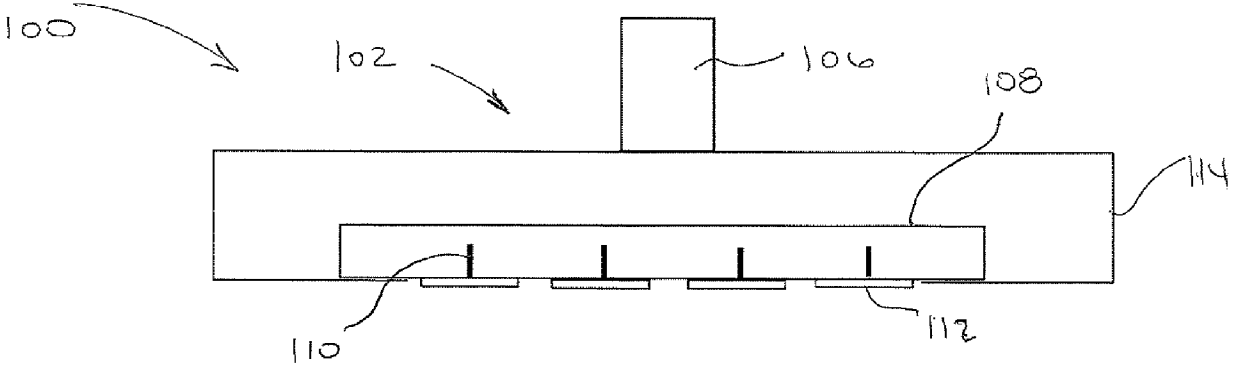

Reference is now made to FIGS. 3A and 3B which schematically illustrate a side view and a front view of connector 102, respectively, according to an exemplary embodiment of the present invention. Connector 102 may include an interconnect board which may be a connector printed circuit board (PCB) 108 having contacts 112 in a forward section and a rear section, and with conductor traces 110 electrically connecting the front section contacts 112A and rear section contacts 112B. Connector 102 may include housing or cover 114 over connector 102.

Figure 4A:
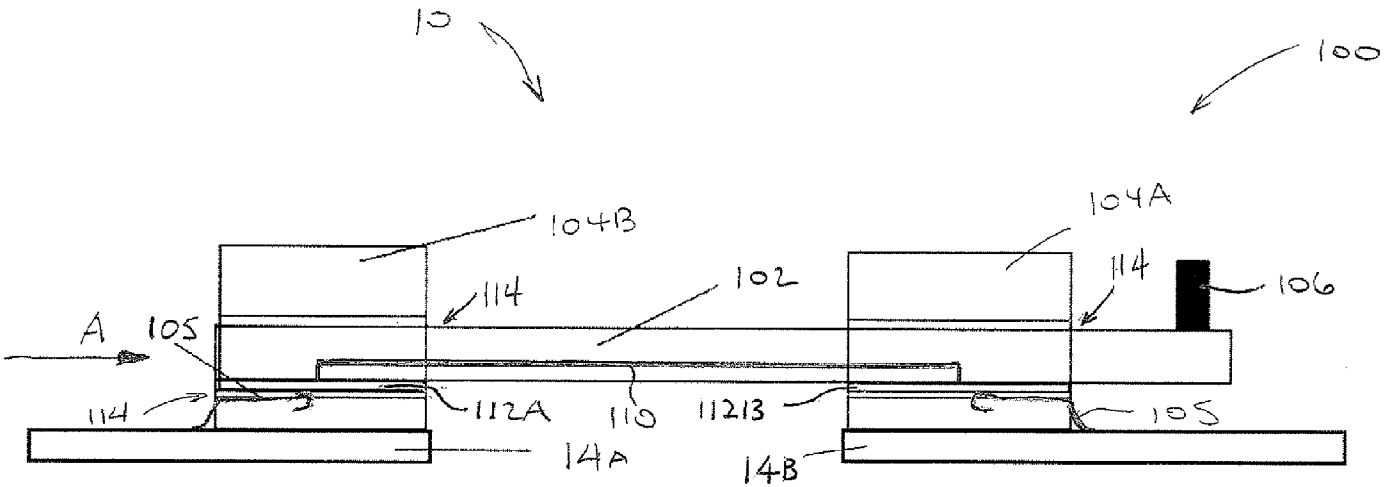
FIGS. 4A and 4B schematically illustrate a side view and a front view of the PCB connection unit interconnecting two PCBs, according to an exemplary embodiment of the present invention.
Figure 4B:
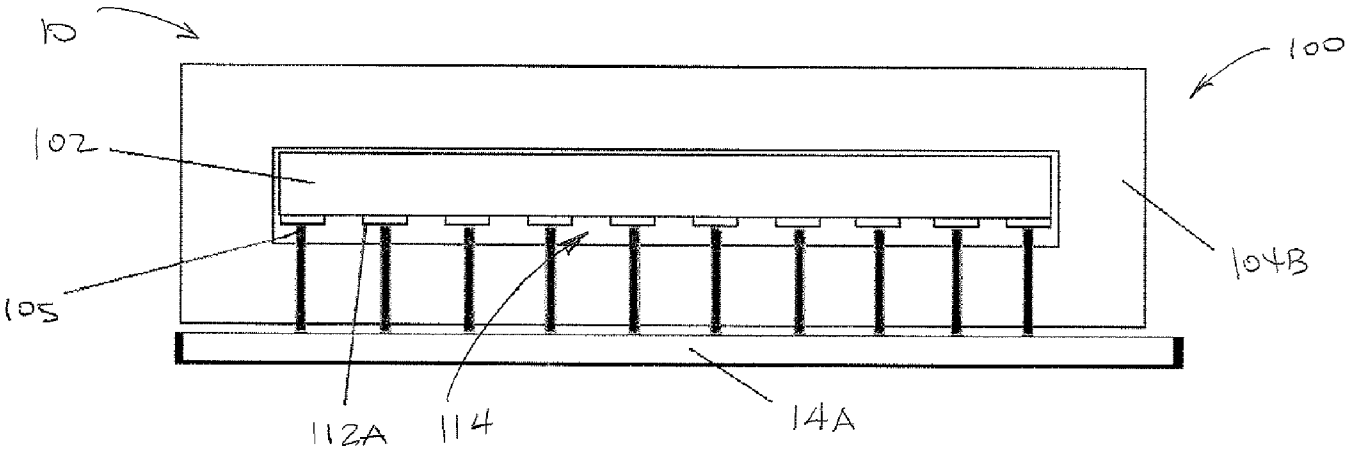
Figure 5:
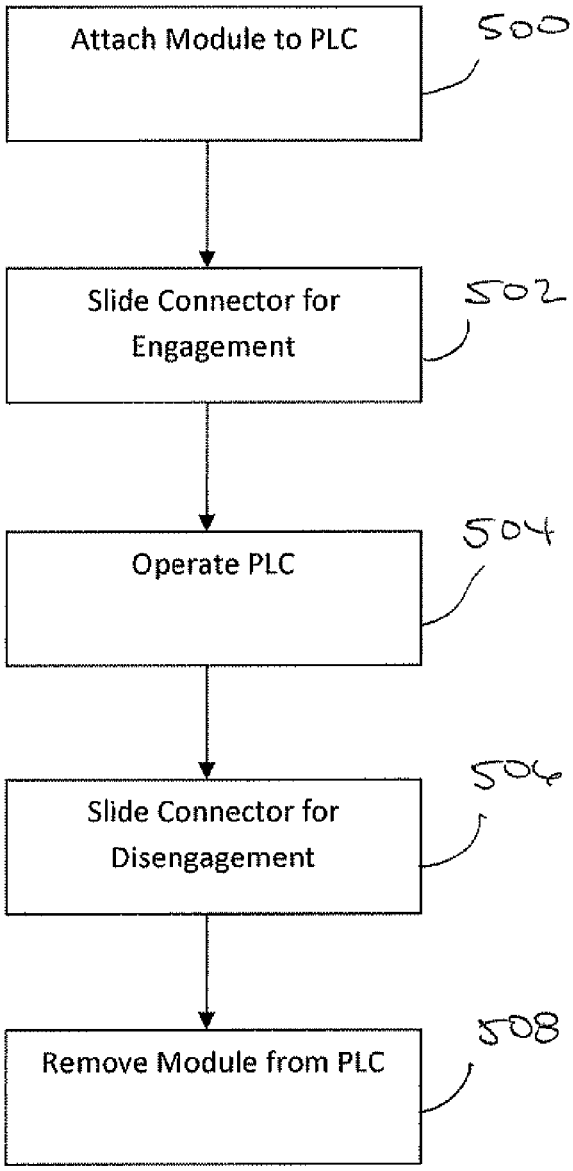
FIG. 5 is a flow chart of a method of using a modular programmable logic controller (PLC) having the PCB connection unit, according to an embodiment of the present invention.

Reference is now also made to FIGS. 4A and 4B which schematically illustrate a side view and a front view A of PCB connection unit 100 with connector 102 electrically interconnecting two PCBs, according to an exemplary embodiment of the present invention. The PCBs may be, for example, PCB 14A in module 12A and PCB 14B in module 12B.

According to an exemplary embodiment of the present invention, PCB 14A may include PCB edge card socket 104B and PCB 14B may include PCB edge card socket 104A. Edge card sockets 104A and 104B may be, but not limited to, a modified version of the guideless sockets from the Mini Edge Card Socket MB1 Series of Samtech Inc., appropriately modified to allow connector 102 to slide inside the sockets. Edge card sockets 104A and 104B may include an opening 114 adapted to accommodate connector 102 and to allow the connector to be slidingly displaced inside the sockets in a forward and a backward direction. Edge card sockets 104A and 104B may include contacts 105 in electrical contact with the respective electronic circuitry in PCBs 14A and 14B. Contacts 105 may be adapted to make electrical contact with contacts 112A and 112B in connector 102 when the connector is positioned in the sockets. For example, contacts 105 in edge socket 104B make electrical contact with forward section contacts 112A and contacts 105 in edge socket 104A make electrical contact with rear section contacts 112B.

According to some exemplary embodiment of the present invention, in a typical mode of operation, when PCBs 14A and 14B are disconnected, connector 102 may be positioned inside edge card socket 104A. To make the electrical connection, the user pushes on handle 106, laterally displacing connector 102 so that it slides inside edge card socket 104A towards, and into, edge card connector 104B. Once inserted into edge card connector 104B, the electrical connection is made between PCBs 14A and 14B. Electricity flow between PCB 14A and 14B may then be facilitated by the electrical contact between PCB 14A through the contacts 105 in edge card connector 104B and front section contacts 112A, contacts 105 in edge card connector 104A and rear section contacts 112B, and conductor trace 110 connecting the front section and rear section contacts in connector PCB 108. To break the electrical connection, the user pulls handle 106 laterally displacing connector 102 so that is slides inside edge card socket 104A away from, and out of, edge card socket 104B. One of ordinary skill in the art may realize that electricity flow between PCBs 14A and 14B may be across connector PCB 108 in any direction and not necessarily limited to a particular direction.

Furthermore, one may realize that the above description regarding the direction of insertion and retrieval of connector 102 is not intended to be limiting and that the direction of insertion and retrieval may be from edge card socket 104B instead of from edge card socket 104A as described above.

It will be appreciated that, with the PCB connection provided by the present invention, adding extensions to existing devices may be done with relative ease and speed, without sacrificing performance generally associated with electrical connectivity restraints.

Unless specifically stated otherwise, as apparent from the preceding discussions, it is appreciated that, throughout the specification, discussions utilizing terms such as "processing," "computing," "calculating," "determining," or the like, refer to the action and/or processes of a computer, computing system, or similar electronic computing device that manipulates and/or transforms data represented as physical, such as electronic, quantities within the computing system's registers and/or memories into other data similarly represented as physical quantities within the computing system's memories, registers or other such information storage, transmission or display devices.

While certain features of the invention have been illustrated and described herein, many modifications, substitutions, changes, and equivalents will now occur to those of ordinary skill in the art. It is, therefore, to be understood that the appended claims are intended to cover all such modifications and changes as fall within the true spirit of the invention.

What is claimed is:

1. An electronic device comprising:

a first base printed circuit board (PCB);

a first edge card socket mounted on said base PCB, said socket having PCB contacts; and a PCB connection unit comprising a printed circuit board having opposing metal contacts connected by metal traces, said unit being slideably connectable to said first edge card socket such that at least some of said metal contacts mechanically and electrically contact said first edge card socket PCB contacts, and adapted to be slideably inserted into a second edge card socket mounted on a second base PCB such that at least some others of said metal contacts mechanically and electrically contact PCB contacts in said second edge card socket, wherein said first edge card socket comprises an opening to allow said PCB connection unit to reciprocally slide forward and backwards through said first edge card socket to make and break an electrical connection between said first base PCB and said second base PCB.

2. The device according to claim 1 wherein said PCB connection unit includes a handle.

3. The device according to claim 1 wherein said first edge card socket includes an opening for slideably connecting said PCB connection unit.

4. The device according to claim 1 wherein said second edge card socket includes an opening for slideably inserting said PCB connection unit.

5. The device according to claim 1 wherein said PCB connection unit includes a housing.

6. The device according to claim 1 wherein said first base PCB is in a first module and said second base PCB is in a second module.

7. The device according to claim 6 wherein said first module includes a window for accessing said connector.

8. The device according to claim 6 wherein said first module and said second module include slots.

9. The device according to claim 6 wherein said first module and said second module are components in a programmable logic controller (PLC).

10. The device according to claim 1 wherein said second base PCB is a component in a second electronic device.

11. A printed circuit board (PCB) connection unit comprising:

a printed circuit board (PCB) having opposing metal contacts connected by metal traces, said unit being slideably connectable to a first edge card socket mounted on a first base PCB such that at least some of said metal contacts mechanically and electrically contact PCB contacts in said first edge card socket, and adapted to be slideably inserted into a second edge card socket mounted on a second base PCB such that at least some others of said metal contacts mechanically and electrically contact PCB contacts in said second edge card socket wherein said first edge card socket comprises an opening to allow said PCB connection unit to reciprocally slide forward and backwards through said first edge card socket to make and break an electrical connection between said first base PCB and said second base PCB.

12. A printed circuit board (PCB) connection unit comprising:

a connecting printed circuit board (PCB) to slidably connect between a first edge card socket mounted on a first electronic device and a second edge card socket mounted on a second electronic device, said connecting printed circuit board having a first set of metal contacts to connect to said first edge card socket and a second set of metal contacts, connected to said first set of metal contacts, to connect to said second edge card socket, wherein said first edge card socket comprises an opening to allow said PCB connection unit to reciprocally slide through forward and backwards said first edge card socket to make and break an electrical connection between said first electronic device and said second electronic device.

* * * * *